US012458102B2

(12) United States Patent
Haimerl

(10) Patent No.: US 12,458,102 B2
(45) Date of Patent: Nov. 4, 2025

(54) SHOE WITH QUICK FASTENER

(71) Applicant: Hero GmbH & Co. KG, Mainburg (DE)

(72) Inventor: Michael Haimerl, Mainburg (DE)

(73) Assignee: Hero GmbH & Co. KG, Mainburg (DE)

( * ) Notice: Subject to any disclaimer, the term of this patent is extended or adjusted under 35 U.S.C. 154(b) by 0 days.

(21) Appl. No.: 18/600,334

(22) Filed: Mar. 8, 2024

(65) Prior Publication Data

US 2024/0298742 A1 Sep. 12, 2024

(30) Foreign Application Priority Data

Mar. 9, 2023 (DE) ..... 102023105849.5

(51) Int. Cl.
*A43B 11/00* (2006.01)
*A43C 11/20* (2006.01)

(52) U.S. Cl.
CPC ..... *A43B 11/00* (2013.01); *A43C 11/20* (2013.01)

(58) Field of Classification Search
CPC ..... A43B 11/00; A43C 11/20; A43C 11/165; A43C 11/008
USPC ..... 36/138
See application file for complete search history.

(56) References Cited

U.S. PATENT DOCUMENTS

| | | | | |
|---|---|---|---|---|
| 6,694,643 | B1 | 2/2004 | Hsu | |
| 8,087,188 | B2 * | 1/2012 | Labbe | A43B 11/00 24/712 |
| 10,271,616 | B2 * | 4/2019 | Labbe | A43C 11/165 |
| 2003/0009917 | A1 * | 1/2003 | Voswinkel | A43B 21/42 24/712 |
| 2010/0299959 | A1 * | 12/2010 | Hammerslag | A43C 11/16 36/50.5 |
| 2021/0196000 | A1 * | 7/2021 | Trudel | A43C 7/08 |

OTHER PUBLICATIONS

Examination Report, issued in DE 10 2023 105 849.5, Nov. 15, 2023 document of 10 pages.

* cited by examiner

*Primary Examiner* — Ted Kavanaugh
(74) *Attorney, Agent, or Firm* — Akerman LLP; Peter A. Chiabotti

(57) ABSTRACT

The application relates to a shoe with a shaft and a sole, wherein the shoe has a spring closure with a spring and a closure element which can be coupled to the spring, wherein the spring can be switched between a tensioned state and a relaxed state, wherein the spring in the tensioned state does not exert any tension on the closure element coupled thereto, so that the shoe is opened for receiving a foot of a wearer, while the spring in the at least partially relaxed state exerts a tension on the closure element, so that the shoe is closed over the foot of the wearer.

5 Claims, 2 Drawing Sheets

SHOE WITH QUICK FASTENER

CROSS-REFERENCE TO RELATED APPLICATIONS

This application claims priority to German Patent Application No. 10 2023 105 849.5, filed Mar. 9, 2023, the entirety of which is incorporated herein by reference.

SUMMARY

The invention relates to a shoe, in particular a boot, with quick fastener.

In order to achieve a quick readiness for use in the event of seriousness, it is of great importance for firefighters that the boots of the emergency personnel can be tightened and closed in the shortest possible time. While boots without lacing or special adaptation to the foot were originally used in particular, but which offer the advantage of being able to be tightened and closed quickly, boots have recently been developed which are equipped with a fastener consisting of a combination of lacing and zip fastener in order to allow both an optimal fit and a quick closing and opening. The combination of lacing and zip fastener is, however, relatively complex and expensive to produce. It is therefore desirable to offer a boot which achieves the objectives of a good fit for the foot and the ability to close quickly, but is less expensive to produce.

The object is achieved by a shoe with a quick fastener having the features according to the main claim. The shoe according to the invention comprises a shaft and a sole, wherein the shoe additionally has a spring fastener or closure with a spring and a fastener element which can be coupled to the spring, wherein the spring can be switched over or released between a tensioned state and a relaxed state, wherein the spring in the tensioned state exerts no tension on the fastener element or closure element coupled thereto, such that the shoe is opened for receiving a foot of a wearer, while the spring in the at least partially relaxed state or released state exerts a tension on the fastener element, such that the shoe is closed over the foot of the wearer.

The spring fastener allows a quick closing of the shoe by utilizing the spring force, which can be released directly, for example, by releasing a bolt, whereby the shoe is transferred from the opened to the closed state in the shortest possible time.

According to one embodiment, the spring fastener or spring closure has a triggering or release device, such as a bolt or locking mechanism, which is configured to release the spring from the tensioned state, such that it transitions or passes into the relaxed state and the shoe is closed. By triggering the triggering device, such as pressing or pulling a lever or button or by pulling on a cable of a bolt or locking mechanism, it becomes possible to close the shoe stripped over the foot particularly quickly.

According to a further embodiment, the fastener element comprises a lacing of the shoe, which can be connected to the spring fastener and wherein the spring fastener is configured to tighten or tension the lacing of the shoe during a transition of the spring or when the spring passes from the tensioned state into the released or at least partially relaxed state. An optimal fit of the shoe on the foot can be achieved with the aid of the lacing. The fastener element can also be formed by a band or cable, which is fixed on one side of the shoe.

According to a further embodiment, the lacing of the shoe is divided into two regions and a fastener or closure of the shoe is assigned to each of the regions, wherein at least one of the fasteners is a spring fastener. By dividing the lacing into two regions, which are assigned, for example, to the foot and the lower leg of the wearer, a fit which is optimally set for the wearer and an optimal fit of the shoe can be achieved.

According to a further embodiment, the shoe has a tab and the spring fastener is connected to the tab, such that the tab is pulled onto the shaft after a release of the spring from the tensioned state. For example, the spring fastener can be arranged on the shaft of the shoe and can be connected to the tab via a lacing, a cable or a band, such that the tab is pulled onto the shaft and the shoe is closed by releasing the spring of the spring fastener. The tab can be connected to the shoe on one side, such as, for example, at its end oriented in the direction of the toes. In addition, the tab can also be connected to the shoe, in particular the shaft, on a longitudinal side or form a part with the latter. The tab can be formed from the material of the shoe or shaft or from another material or can comprise the latter. In particular, the material of the tab can be flexible or rigid and can comprise or be formed from a leather or a plastic or textile. In particular, the tab can be produced from an injection-molded material and can have a rigid structure. The tab can have the function of a protector or shin guard. The tab can be provided on the inner side or outer side with another material, such as, for example, padding. The shoe can be a boot, in particular a boot for emergency personnel, such as firefighters, police or disaster protection.

According to a further embodiment, the spring of the spring fastener is a spiral or helical spring, which can be pretensioned by a rotary mechanism. The rotary mechanism can comprise the cover of a housing of the spring fastener, which can be rotated with respect to the housing, in which the spiral spring is arranged and fixed at one end. In the housing of the spring fastener, a locking or latching mechanism or bolt can be provided, which is coupled to the cover, such that the spring, which is likewise coupled to the cover, can be tensioned by rotating the cover. By means of the locking or latching mechanism or bolt, an independent reverse rotation of the cover is prevented by the tensioned spiral spring. The spiral spring is connected to the lacing, the cable or band, such that the latter is carried along and tensioned or tensioned by the relaxation movement of the spring or the spring force thereof when the locking or latching mechanism or bolt is released. As a result, the shoe is closed.

According to a further embodiment, the shoe has a tab and the spring fastener is arranged on the tab and is connected to the shaft, such that the shoe is closed by the tab after the release of the spring of the spring fastener.

According to a further embodiment, the spring fastener is arranged on the tab and is connected to the shaft, such that the shoe is closed by the tab after the triggering of the spring fastener. For example, the spring fastener can be connected to the shoe or shaft via a lacing, a cable or a band, such that the tab is pulled onto the shaft and the shoe is closed by releasing the spring of the spring fastener. As indicated above, the tab can be connected to the shoe on one side, such as, for example, at its end oriented in the direction of the toes. In addition or alternatively, the tab can also be connected to the shoe, in particular the shaft, on a longitudinal side or form a part with the latter.

BRIEF DESCRIPTION OF THE DRAWINGS

Further features, properties and advantages of the invention emerge from the embodiment of the invention described below with reference to the drawing, in which FIG. 1 schematically shows a shoe according to an embodiment of the invention.

DETAILED DESCRIPTION

Figure 1:
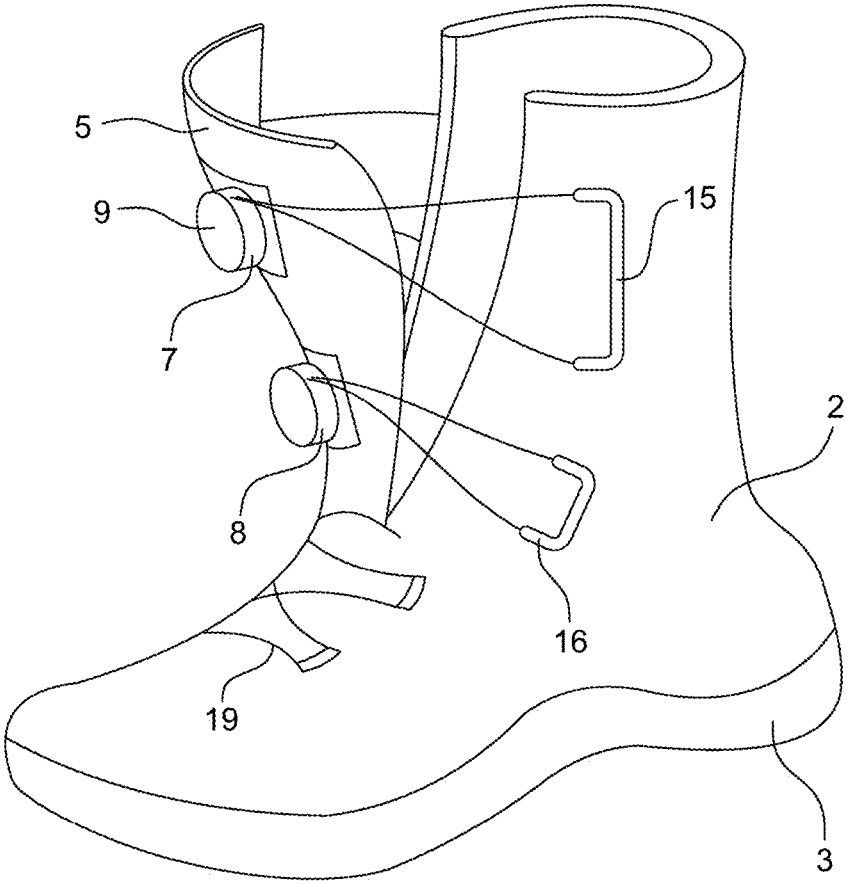
Figure 2:
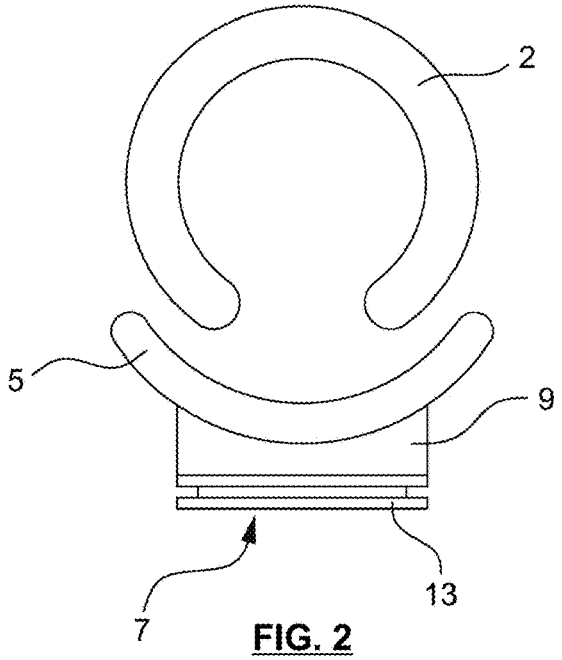
FIG. 2 schematically shows the shoe in a view from above.
Figure 3:
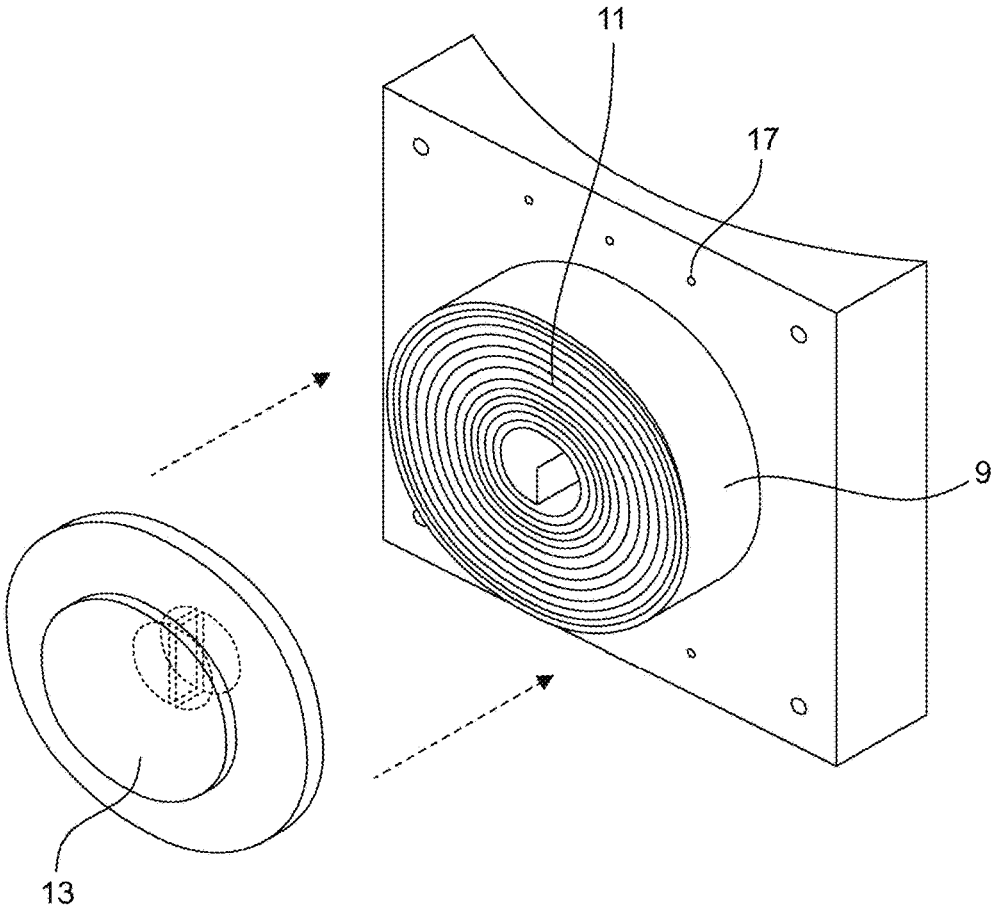
FIG. 3 shows a spring fastener according to an embodiment of the invention.

An embodiment of the shoe 1 according to the invention is described below with reference to the figures. The shoe 1, as schematically illustrated in FIG. 1, comprises a shaft 2, a sole 3 and a tab 5. The tab 5 is pivotably connected to the shoe 1 at its lower, toe-side end. A first spring fastener 7 is arranged on the tab 5 at the level of the lower tibia and a second spring fastener 8 is arranged on the instep. The spring fastener 7, 8 illustrated in detail in FIG. 3 is inserted from the rear side of the tab 5 through openings in the tab 5 and fastened to the tab 5 by fastening means, such as, for example, rivets. The spring fastener 7, 8 has a round housing 9, which is arranged on a base plate and in which a spiral spring 11 is arranged, which is coupled or fixed at one end to a cover 13 and at the other end to the housing 9.

In addition, the shoe 2 has an upper lacing 15 and a lower lacing 16, which are releasably connected to the respective cover 13 of the upper or lower spring fastener 7, 8 and are fixed on both sides of the shaft 2. Each of the spring fasteners 7, 8 can be tensioned by rotating the respective cover 13. A latching mechanism or bolt is arranged in the housing 9, such that the spiral spring 11 can be pretensioned to a specific tension by rotating the cover 13 and is then held in the tensioned state by the latching mechanism. By releasing the latching mechanism by means of a release button or cable, the spring transitions into the relaxed state, wherein the cover 13, which is coupled to one end of the spiral spring 11, is rotated and the respective lacing 15, 16, which is fixed to the shaft, is tightened by the spring force of the respective spiral spring 11. In this case, the tab 5 is pulled onto the shaft and the shoe 1 is closed over the foot. The hold of the shoe on the foot is determined substantially by the spring force of the spiral spring 11. During tightening, the lacings 15, 16 are each wound up in a receptacle, which is provided in the respective cover 13, by the spiral spring 11 during the rotation of the cover 13. As a result, no parts of the lacing hang down loosely from the shoe 1 and the risk of catching or hanging of the shoe 1 can be avoided.

As a result of the direct unfolding of the tensioning force of the spiral spring 11 when the latching mechanism is released, the shoe 1 is closed particularly quickly. As a result of the provision of two separate lacings 15, 16 and spring fasteners 7, 8, the tensioning force can be distributed better between the lower and the upper part of the foot. As a result, the wearing comfort can be increased.

In order to open the shoe, the respective cover 13 is rotated by hand counter to the tensioning force of the spiral spring 11 of the respective spring fastener 7, 8 and therefore the lacing 15, 16 is unwound and relaxed. The opening of the shoe can alternatively or additionally also be achieved by pulling on the tab 5 and therefore on the lacing 15, 16 counter to the spring force of the spiral spring 11. On the other hand, as a result of the rotation or pulling, the spring 11 is tensioned and the spring force is stored in the spring 11 at the same time. The rotation of the cover or the pulling on the tab 5 is continued until the cover 13 latches in the latching mechanism, such that the cover 13 can be released without the spiral spring 11 unfolding the spring force and the lacing 15, 16 being tensioned. The described tensioning and release process is the same for the first and the second spring fastener 7, 8.

The shoe 1 additionally has a further lacing 19 over the central part of the foot on the metatarsal.

The shoe 1 shown can be a firefighter boot or some other boot. However, the shoe 1 shown can also be an inner shoe of a boot, such as a firefighter boot or a ski boot.

Numerous modifications can be made to the embodiment shown without departing from the scope of the invention. In particular, at least one spring fastener 7, 8 could be arranged on the shaft 2 of the shoe 1. Instead of two spring fasteners 7, 8, only one can be provided. A fastener without a spring could also be used instead of one of the spring fasteners 7, 8. A cable or band can also be used instead of a lacing. The cable or band can also be fixed to the shoe only on one side, while the other is fixed to a fastener, in particular a spring fastener.

LIST OF REFERENCE SIGNS

1 shoe
2 shaft
3 sole
5 tab
7, 8 spring fastener
9 housing of the spring fastener
11 spring
13 cover of the spring fastener
15 upper lacing
16 lower lacing
17 opening
19 lacing

The invention claimed is:

1. A shoe, comprising:

a shaft, a tab that is at least partially arranged over the shaft, and a sole, a spring closure with a spring and a closure element which can be coupled to the spring, wherein the spring can be switched between a tensioned state and a relaxed state, wherein the spring in the tensioned state does not exert a tension on the closure element coupled thereto, so that the shoe is opened for receiving a foot of a wearer, while the spring in an at least partially relaxed state exerts a tension on the closure element so that the shoe is closed over the foot of the wearer, wherein the spring closure is connected to the tab so that, after the spring is released from the tensioned state, the tab is pulled onto the shaft.

2. The shoe according to claim 1, wherein the closure element comprises a lacing of the shoe which can be connected to the spring closure, and wherein the spring closure is designed to tension the lacing of the shoe when the spring passes from the tensioned state into the relaxed state.

3. The shoe according to claim 2, wherein the lacing of the shoe is divided into two regions and a closure of the shoe is assigned to each of the regions, and wherein at least one of the closures is a spring closure.

4. The shoe according to claim 1, wherein the spring of the spring closure is a helical spring which can be tensioned by a rotary mechanism.

5. The shoe according to claim 1, wherein the shoe has a tab, and the spring closure is arranged on the tab and is connected to the shaft, so that the shoe is closed by the tab after the spring of the spring closure is released.

* * * * *